United States Patent [19]

Lee

[11] 4,089,440

[45] May 16, 1978

[54] HANDLE SUPPORT AND OPERATING ASSEMBLY FOR AEROSOL SPRAY CANS

[76] Inventor: Edward Lee, 12 Bonavista Place, Winnipeg, Canada

[21] Appl. No.: 701,571

[22] Filed: Jul. 1, 1976

[51] Int. Cl.[2] ..... B65D 83/14

[52] U.S. Cl. ..... 222/174; 222/402.11; 222/402.15; 222/473; 222/509

[58] Field of Search ..... 222/174, 153, 402.11, 222/402.13, 402.15, 505, 182, 473, 509

[56] References Cited

U.S. PATENT DOCUMENTS

| | | | |
|---|---|---|---|
| 2,706,660 | 4/1955 | Johnson et al. | 222/402.13 X |
| 3,112,849 | 12/1963 | Wallace | 222/402.15 X |
| 3,149,761 | 9/1964 | Harris et al. | 222/402.11 X |
| 3,172,582 | 3/1965 | Belpedio | 222/473 |
| 3,185,350 | 5/1965 | Abplanalp et al. | 222/402.13 X |
| 3,229,859 | 1/1966 | Conroy et al. | 222/174 |
| 3,506,159 | 4/1970 | Muller | 222/473 X |

FOREIGN PATENT DOCUMENTS

| | | | |
|---|---|---|---|
| 2,502,903 | 8/1975 | Germany | 222/402.13 |

*Primary Examiner*—Robert B. Reeves
*Assistant Examiner*—Charles A. Marmor
*Attorney, Agent, or Firm*—Stanley G. Ade

[57] ABSTRACT

A handle attachment snap engages over the top of an aerosol can and includes a trigger adapted to depress the spray button. The device fits most sizes of cans and adaptor rings may be provided to ensure a firmer support for smaller cans. The handle attachment and associated aerosol can may be secured to and elevated on a pole or other elongated support and operated remotely for spraying of trees, buildings, and the like. A partially rotatable shroud is provided which, when in one position, enables the trigger to be operated in order to dispense the contents of the can through the spray nozzle and when in the other position, prevents the trigger from being depressed and also shrouds the nozzle if the can is improperly placed within the assembly.

10 Claims, 16 Drawing Figures

HANDLE SUPPORT AND OPERATING ASSEMBLY FOR AEROSOL SPRAY CANS

BACKGROUND OF THE INVENTION

This invention relates to new and useful improvements in devices adapted to be detachably secured to aerosol cans.

Conventional aerosol cans of various sizes, all operate by depressing a spray button and dispenser situated on the upper end of the can.

When used intermittently, the majority of individuals do not experience any difficulty in operating the spray button and dispenser by the forefinger but when a can is used for relatively long periods such as when dispensing paint, insecticide, rug cleaners or the like, it is difficult to maintain the pressure upon the spray button and to maintain any accuracy and control of the spraying action.

Furthermore, some individuals with arthritic fingers, find it impossible to actuate any form of spray can for any amount of time.

SUMMARY OF THE INVENTION

The present invention overcomes these disadvantages by providing a handle assembly which is adapted to snap engage over the upper end of a spray can thus making the supporting of the spray can relatively easy. A trigger assembly is pivoted in the handle assembly so that when it is squeezed, the spray button and dispenser is depressed readily and easily both by normal individuals and individuals with arthritic fingers for example.

Another object of the invention is to provide a device of the character herewithin described which includes a rotatable shroud which, when in one position, prevents actuation of the trigger and which when in another position, permits actuation of the trigger and the dispensing of the contents of the can.

A still further object of the invention in conjunction with the foregoing object, is to provide a device of the character herewithin described in which the shroud prevents inadvertent discharge of the contents in the wrong direction if the spray can is not situated correctly so that the contents spray in the desired direction.

Still another object of the invention is to provide a device of the character herewithin described which includes various adaptor rings to enable small heavy cans to be additionally supported by the device.

A still further object of the invention is to provide a device of the character herewithin which is adapted for support upon an elongated pole or the like and includes means to actuate the spray nozzle assembly remotely so that a spray can can be used for example to spray insecticide upon high bushes or trees or to enable paint to be sprayed on buildings beyond the normal reachable height.

Still another object of the invention is to provide a device of the character herewithin described in which the trigger lock assembly and the snap engagement of the assembly upon the cans, acts to prevent small children from inadvertently operating spray cans which may contain noxious substances.

Yet another object of the invention is to provide a device of the character herewithin described which is simple in construction, economical in manufacture, and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

Figure 1:
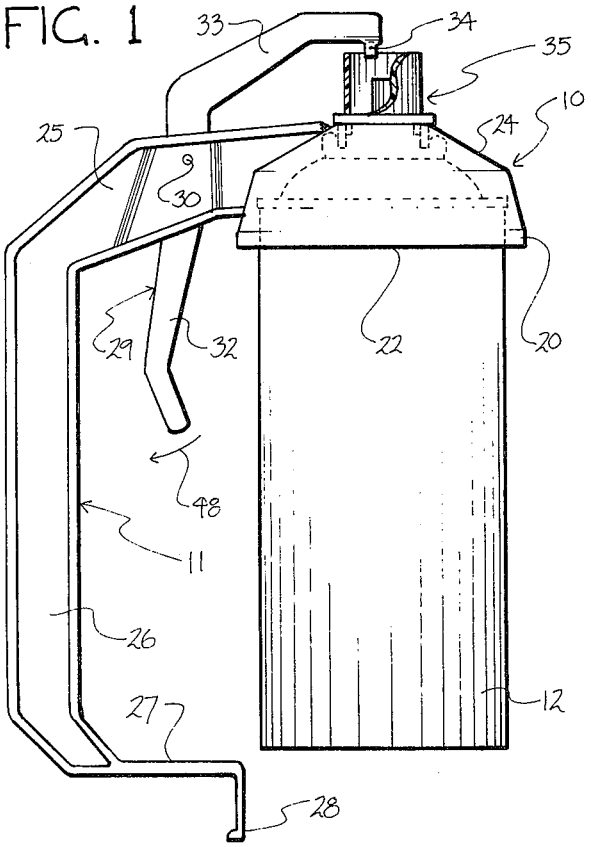
FIG. 1 is a side elevation of the device engaged upon a relatively small spray can.

Before proceeding with the description of the invention, it should be noted that aerosol spray cans come in various sizes.

The relatively small can is popular for small quanities of materials to be dispensed whereas the standard can is slightly larger in diameter and usually longer.

The industrial sized can is slightly larger again in diameter and considerably longer than the standard can.

These are the three main sizes although there are some variation in diameter for the small can.

However the spray button assembly of all cans is standardized and includes a cylindrical portion sealed within the top domed portion of the can and having the spray button and dispenser centrally located therein with the cylindrical portion being the same diameter in all cases.

DETAILED DESCRIPTION

Proceeding therefore to describe the invention in detail, the device is preferably made from synthetic plastic and includes a can top portion engaging component collectively designated 10 with a handle collectively designated 11 extending outwardly and downwardly from one side thereof.

The conventional aerosol can is normally cylindrical in configuration and includes the main body portion 12 and a domed top portion 13 which terminates in the conventional spray button assembly collectively designated 14. This spray button assembly includes a depressible spray button and dispenser 15 having a dispensing aperture 16 on one side thereof.

The spray button assembly includes an upstanding cylindrical rim 17 having the inner surface 18 thereof formed in a rounded configuration in the form of a small bead.

The component 10 is substantially domed shaped and is provided with a central aperture 19 and a lower annular skirt 20 having a bead 21 formed around the interior thereof just spaced from the lower edge 22 thereof.

A cylindrical sleeve 23 is formed integrally with the domed portion 24 and extends downwardly around the center of the domed portion defining the central aperture 19.

The handle 11 is formed integrally with the component 10 and extends outwardly therefrom as indicated by reference character 25 and then downwardly to form a hand engaging portion 26. It terminates with an inturned portion 27 and a downturned clamp portion 28, the purpose of which will hereinafter be described.

A trigger collectively designated 29, is pivoted intermediate the ends thereof by means of pivot pin 30, through a vertical slot 31 formed in the portion 25 of the handle and this trigger includes the actuating portion 32 situated between the portion 26 of the handle and the associated can 12, and the spray button engaging portion 33. This portion 33 extends upwardly and over towards the central aperture 19 of the domed portion 10 and includes a downwardly inclining button engaging knob or portion 34.

A shroud collectively designated 35 is engaged within the aperture 19 and is mounted therein for partial rotation. In this connection, the lower end 36 of the shroud is in the form of a sleeve having an external bead 37 formed thereon which engages within a small annular recess 38 formed adjacent the upper end of the sleeve 23 situated within the domed portion 10.

An annular flange 39 extends outwardly from the shroud just above the portion 36 and rests upon the upper side of the domed portion 10 when the shroud is in position.

This flange is provided with a cutaway portion 40, the purpose of which will hereinafter be described.

The upstanding wall portion 41 of the shroud is substantially cylindrical in configuration and is provided with vertical striations 42 to provide a grip for the operator to rotate the shroud as will hereinafter be described.

A relatively small notch or cutout portion 43 is formed in the upper end of the wall 41 and a further slot or notch 44 is formed the entire depth of the wall portion 41 situated diametrically opposite to the cutout portion 43.

The slot 43 is a trigger engageable slot and the slot 44 acts as a dispenser slot.

Figure 2:
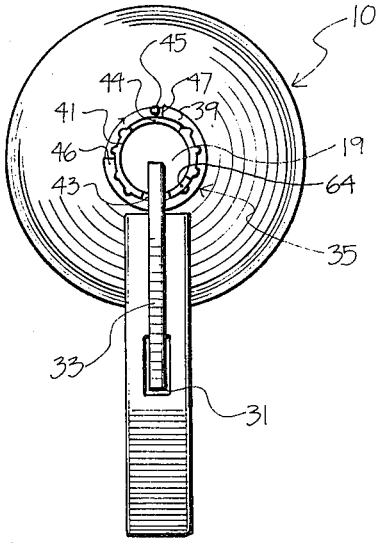
FIG. 2 is a top plan view of FIG. 1.

When snapped engaged for partial rotation within the upper end of the domed portion 10, the shroud can be partially rotated from a trigger operating position illustrated in FIG. 2 to a trigger locked position radially shifted from the trigger operating position.

A stop pin 45 extends upwardly from the domed portion 10 and is engaged by the ends 46 and 47 of the flange 39. When in the position shown in FIG. 2, the shroud is situated so that the portion 33 of the trigger can depress within the notch 43 when the portion 29 of the trigger is moved in the direction of arrow 48.

However when the shroud is rotated so that the end 46 of the flange engages the stop 45, the portion 33 of the trigger is prevented from moving downwardly because it engages the upper side 49 of the shroud thus preventing inadvertent operation of the device.

When in the trigger operating position, movement of the trigger portion 32, causes the portion 33 to move downwardly so that the depending portion 34 thereof engages the upper end of the spray button and dispenser 15 and depresses same. Assuming the can is aligned correctly, the contents of the can will be dispensed through the aperture 16 and through the slot 44.

If however the can is misaligned radially, then the spray strikes the inside of the shroud and is prevented from spraying in the wrong direction by the fact that this shroud extends upwardly to a position above the aperture 16.

FIG. 1 shows the device snapped engaged upon a relatively small spray can 12 with the sleeve 23 engaged within the collar or lip 17 of the spray can.

Figure 7:
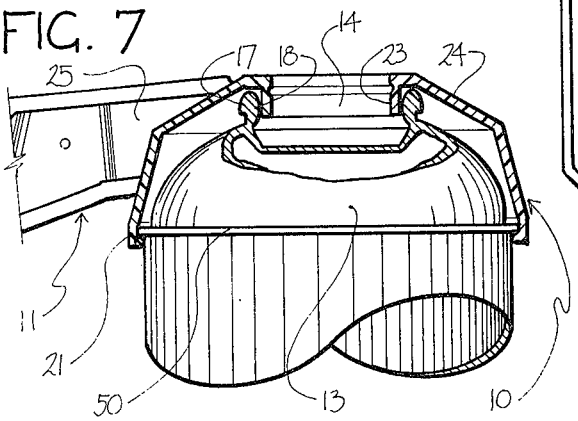
FIG. 7 is a view similar to FIG. 6 but showing the device engaged with what is known as a standard spray can.

FIG. 7 shows the device in use upon a standard spray can in which the collar 23 is also snap engaged within the lip or collar 17. Additional support is provided by the annular bead 21 at the lower end of the wall 20, snap engaging over the standard bead or band 50 provided on spray cans between the upper domed portion and the main body of the can. This gives additional support for this slightly larger can.

Figure 8:
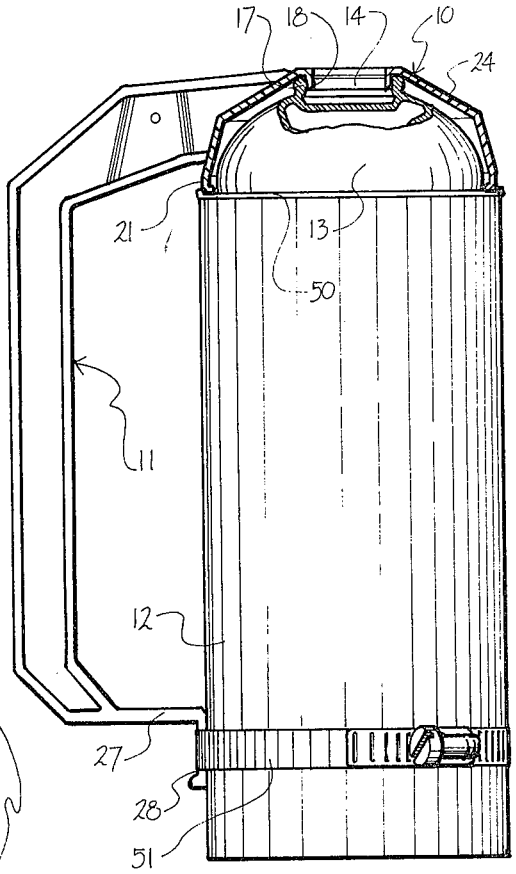
FIG. 8 is a side elevation showing the device engaged upon a large spray can.

When used with a relatively large can such as used industrially, additional support is provided as shown in FIG. 8. Due to the larger diameter of such cans, the vertical wall portion 20 of the portion 10 engages within the lip or bead 50 which normally is slightly upstanding annular depression around the domed portion of the can. This steadys the can within the assembly which is also snap engaged by means of the sleeve 23 within the lip or collar 17. Additional support is provided by a conventional hose clamp 51 surrounding the can and the downwardly depending portion 28 of the handle which is clamped to the can at this point as clearly shown in FIG. 8.

Figure 9:
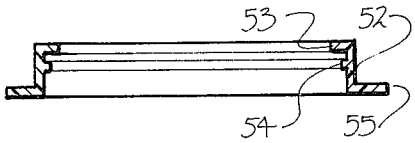
FIG. 9 is a cross sectional view of one embodiment of an adaptor ring.

Some of the smaller cans require more support than may be provided by the snap engagement of the sleeve 23 within the collar 17. Under these circumstances, an adaptor ring illustrated in FIGS. 9 or 10 may be used. The adaptor ring in FIG. 9, is made of synthetic plastic and is provided with a vertical wall portion 52, and upper internally extending annular flange 53 and an intermediate annularly extending bead 54.

An outwardly extending annular flange 55 extends from below a side of the vertical wall portion 52.

Figure 9A:
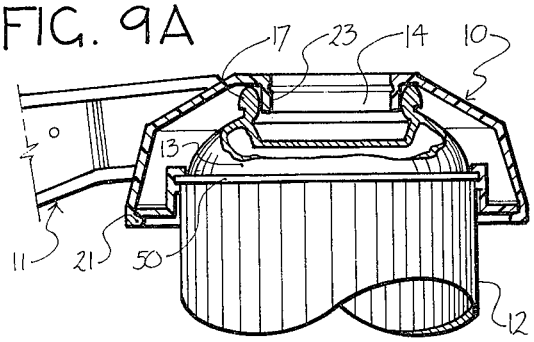
FIG. 9A shows the adaptor ring of FIG. 9, in section, engaged upon a spray can with the top portion engaging component engaged upon the ring.

This adaptor ring can be snap engaged over the bead 50 of the can as illustrated in FIG. 9A and the diameter of the flange 55 is such that it can be snap engaged by the vertical wall portion 20 of the portion 10.

Figure 10:
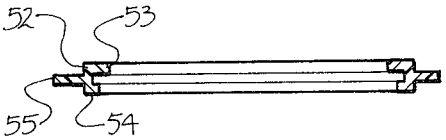
FIG. 10 is a view similar to FIG. 9 showing an alternative embodiment.
Figure 10A:
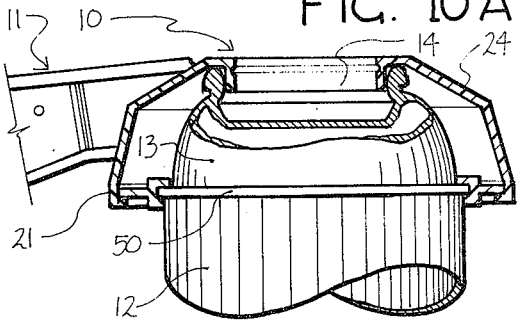
FIG. 10A is a view similar to FIG. 9 but showing the embodiment illustrated in FIG. 10.

FIG. 10 shows an adaptor ring similar in construction but having slightly different dimensions and FIG. 10A shows this adaptor ring engaged by the portion 10 of the device.

Adaptor ring 10 can be used on cans having a slightly larger diameter than those upon which the adaptor ring of FIG. 9 can be used.

Both of the adaptor rings are preferably made of synthetic plastic and are slightly flexible to enable the various snap engagements to take place.

Occasionally it may be desirable to utilize an aerosol spray can at a distance remote from the operator.

Under these circumstances, the device illustrated in FIGS. 11 through 14 may be utilized.

An adaptor support collectively designated 56 consists of a saddle portion 57 and a socket portion 58. The saddle portions are adapted to engage around part of the surface of the spray can as shown in FIG. 14 and they are clamped into position by means of conventional hose clamps 51A.

Figure 14:
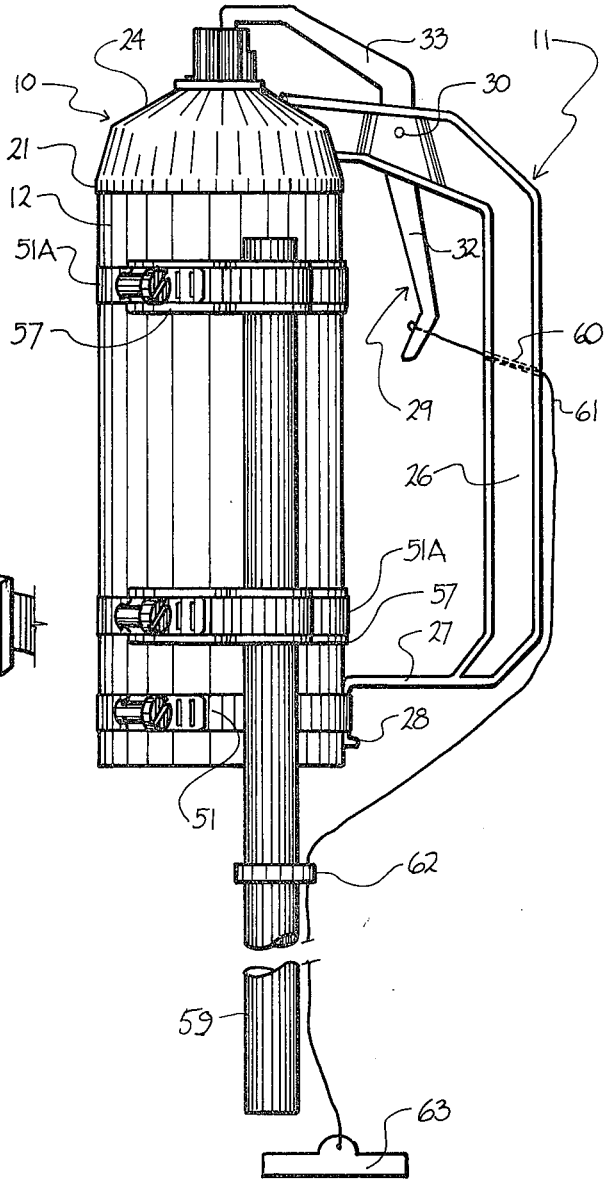
FIG. 14 is a side elevation of a spray can with the assembly in position and showing the adaptor supports clamped to the can.

It is desirable that a pair of these adaptor supports be clamped to the can in spaced relationship as shown in FIG. 14.

An elongated support such as a pole 59 is engaged through the sockets 58 and is clamped into position by means of the hose clamps 51A. This elongated support 59 extends the desired distance to enable the can to be positioned by an operator holding the other end of the support 59.

Figure 11:
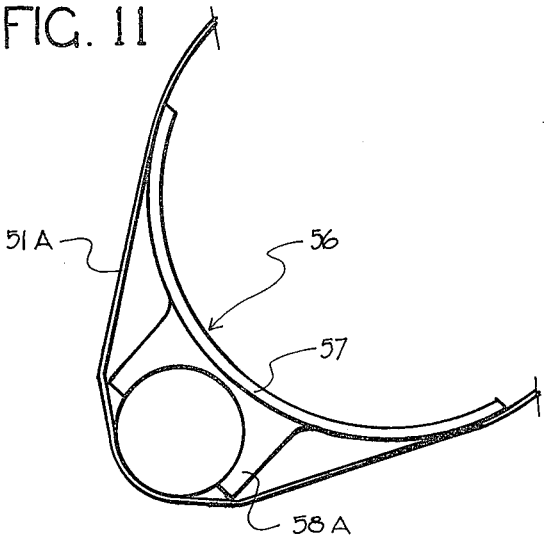
FIG. 11 is a top plan view of one of the adaptor supports.
Figure 12:
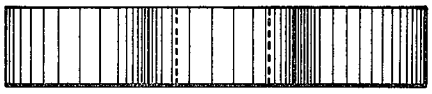
FIG. 12 is a rear view of FIG. 11.
Figure 13:
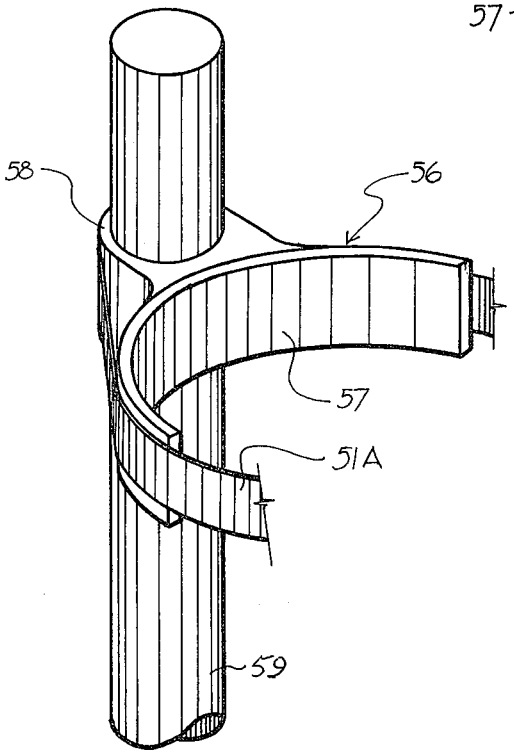
FIG. 13 is an isometric view of FIG. 11.

FIG. 11 shows a modification of the socket formation in which the socket 58A is formed so that it does not completely surround the pole 59. Under these circumstances the hose clamp 51A will, of course, engage the pole 59 and assist in maintaining same firmly in position.

A diagonally situated drilling 60 extends through the portion 26 of the handle in a position so that a flexible wire or cable 61 extending therethrough may be attached to the portion 32 of the trigger so that tension upon the cable 61 will actuate the trigger thus actuating the aerosol spray can.

A guide 62 may be fastened to the pole or support 59 to guide the cable 61 and a bale 63 may be secured to the other end of the cable so that the operator can actuate the trigger from adjacent the lower end of the pole or support.

It should be stressed that the provision of the snap engagement of the device upon the top of the can together with the shroud which can be moved to a locked position, gives considerable protection to small children particularly when the device is used upon aerosol spray cans containing dangerous substances.

Figure 3:
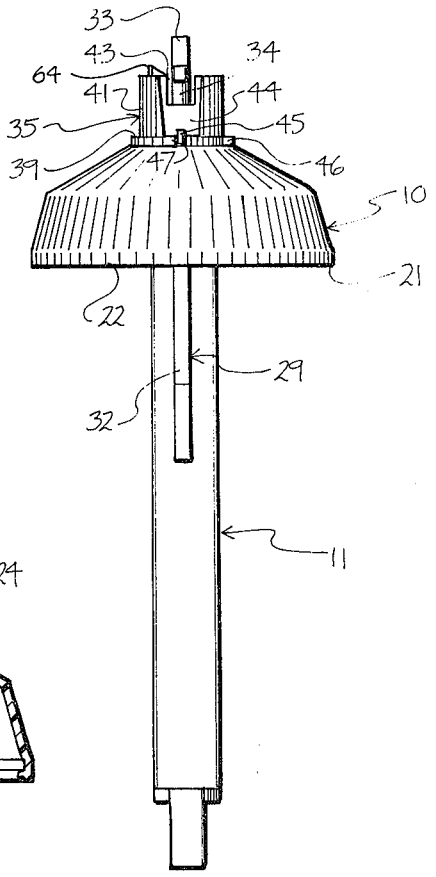
FIG. 3 is a view of the assembly per se at right angles to that of FIG. 1.
Figure 4:
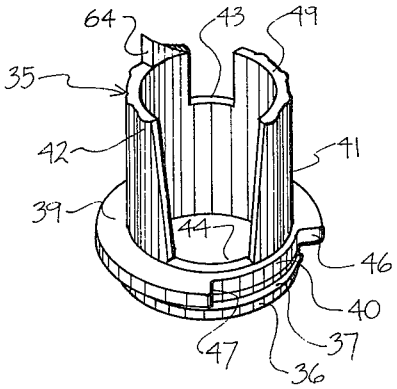
FIG. 4 is an enlarged isometric view of the shroud component per se.
Figure 5:
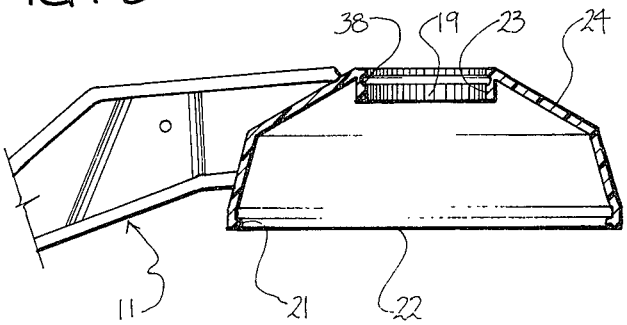
FIG. 5 is a cross sectional view of the top portion engaging component per se.
Figure 6:
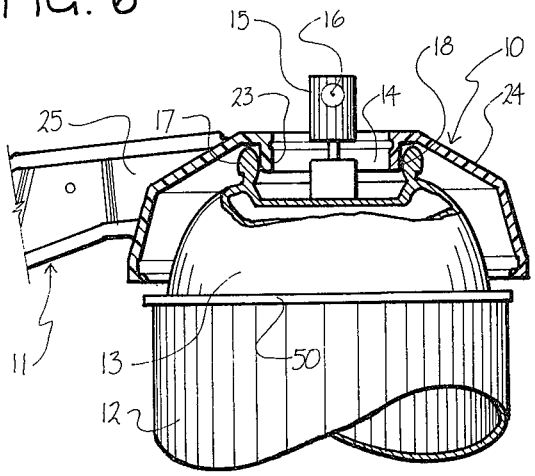
FIG. 6 is a view similar to FIG. 5 but showing it in engagement with the upper end of a relatively small spray can which in turn is partially sectioned for clarity.

In this connection, reference should be made to FIGS. 2, 3 and 4 in which a small cammed stop 64 is formed on the upper edge or side 49 of the shroud to one side of the notch 43. When the shroud is rotated so that the end 46 of the shroud engages stop 45, then the portion 33 of the trigger overrides this cammed stop 64 thereby preventing rotation of the shroud until this portion of the trigger is manually lifted clear. This assists in preventing undesirable operation of the device, particularly by small children.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A handle support and operating assembly for aerosol spray cans which include a substantially domed top portion, an upstanding lip between said top portion and the remainder of the can, a cylindrical spray button assembly situated centrally within said domed top portion and a spray button and dispenser extending upwardly from said spray button assembly; said handle support and operating assembly comprising in combination a centrally apertured, top portion engaging component and a handle extending downwardly from one side thereof, means to snap engage said component with said cylindrical spray button assembly, a trigger pivotally mounted in said handle and having an actuating end and a spray button engaging end, and a shroud surrounding the aperture in said top portion engaging component and extending upwardly from said component with said spray button and dispenser being surrounded by said shroud when said assembly is engaged upon the spray can, said shroud being moveable from a trigger operating position to a trigger locked position and vice versa, said spray button engaging end of said trigger, when said shroud is in said trigger operating position, being engageable with said spray button to depress same when said trigger is actuated by said operating end, said shroud being cylindrical and mounted for partial rotation upon said component and surrounding said aperture, the wall of said shroud having a slot therein selectively engageable by the spray button engaging end of said trigger, and a dispenser slot formed in said shroud diametrically opposite to said first mentioned slot whereby, when in said trigger operating position, said spray button engaging end of said trigger can depress said spray button and dispenser and the contents of the can are thereby dispensed through said dispenser slot, and when said shroud is in the trigger locked position, the upper edge of said shroud prevents said spray button engaging end of said trigger from depressing said spray button and dispenser and said spray button and dispenser is shrouded by the wall of said shroud and additional means to support the spray can within said component, said additional means including an annular bead formed around the inside of the lower edge of said component snap engaging over the said upstanding lip of said spray can.

2. The assembly according to claim 1 in which said spray button assembly includes an upstanding cylindrical rim having an annular bead forming the inner surface thereof, said means to snap engage said component with said cylindrical spray button assembly including a cylindrical sleeve extending downwardly from around the aperture in said component, snap engageable within said upstanding cylindrical rim of said spray button assembly.

3. The assembly according to claim 2 which includes an adaptor ring to provide additional support for said assembly upon said spray can, said adaptor ring including means to snap engage said adaptor ring over the annular bead between the top portion of said can and the remainder of said can, and an outwardly extending annular flange formed on said adaptor ring, and means around the lower end of said top portion engaging component to snap engage with said flange.

4. The assembly according to claim 2 which includes means to mount said can and said assembly for remote activation, said last mentioned means including at least one adaptor support detachably secured to said can, said adaptor support including a saddle portion engaging part of the surface of said can and socket formed within said adaptor support, elongated support and operating means detachably engageable within said socket and means to operate said trigger remotely when said assembly and the associated can is engaged upon said elongated support and operating means.

5. The assembly according to claim 1 which includes means to mount said can and said assembly for remote activation, said last mentioned means includng at least one adaptor support detachably secured to said can, said adaptor support including a saddle portion engaging part of the surface of said can and socket formed within said adaptor support, elongated support and operating means detachably engageable within said socket and means to operate said trigger remotely when said assembly and the associated can is engaged upon said elongated support and operating means.

6. The assembly according to claim 5 which includes clamp means detachably surrounding the can and the lower distal end of said handle to hold said handle firmly in position upon the lower portion of said can.

7. The assembly according to claim 1 which includes an adaptor ring to provide additional support for said assembly upon said spray can, said adaptor ring including means to snap engage said adaptor ring over the annular bead between the top portion of said can and the remainder of said can, and an outwardly extending annular flange formed on said adaptor ring, and means around the lower end of said top portion engaging component to snap engage with said flange.

8. The assembly according to claim 7 which includes means to mount said can and said assembly for remote activation, said last mentioned means including at least one adaptor support detachably secured to said can, said adaptor support including a saddle portion engaging part of the surface of said can and socket formed within said adaptor support, elongated support and operating means detachably engageable within said socket and means to operate said trigger remotely when said assembly and the associated can is engaged upon said elongated support and operating means.

9. The assembly according to claim 7 which includes clamp means detachably surrounding the can and the lower distal end of said handle to hold said handle firmly in position upon the lower portion of said can.

10. The assembly according to claim 1 which includes clamp means detachably surrounding the can and the lower distal end of said handle to hold said handle firmly in position upon the lower portion of said can.

* * * * *